US007731701B2

(12) United States Patent
Simon et al.

(10) Patent No.: US 7,731,701 B2
(45) Date of Patent: Jun. 8, 2010

(54) PACKAGED PRODUCT APPLICATOR OR PERSONAL CARE APPLICATOR

(75) Inventors: Pascal Simon, Vitry sur Seine (FR); Kenji Nakamura, Hyogo-ken (JP); Isao Kuraishi, Kyoto (JP)

(73) Assignee: L'Oreal, Paris (FR)

( * ) Notice: Subject to any disclaimer, the term of this patent is extended or adjusted under 35 U.S.C. 154(b) by 854 days.

(21) Appl. No.: 10/497,163

(22) PCT Filed: Dec. 2, 2002

(86) PCT No.: PCT/EP02/14813

§ 371 (c)(1),
(2), (4) Date: Jun. 8, 2004

(87) PCT Pub. No.: WO03/051739

PCT Pub. Date: Jun. 26, 2003

(65) Prior Publication Data

US 2005/0011780 A1 Jan. 20, 2005

(30) Foreign Application Priority Data

Dec. 14, 2001 (JP) ..... 2001-381747

(51) Int. Cl.
*A61M 35/00* (2006.01)

(52) U.S. Cl. ..... 604/292

(58) Field of Classification Search ..... 604/292
See application file for complete search history.

(56) References Cited

U.S. PATENT DOCUMENTS

| | | | | |
|---|---|---|---|---|
| 2,621,784 | A | 12/1952 | Boytham | |
| 3,608,708 | A | 9/1971 | Storandt | |
| 3,870,150 | A | 3/1975 | Hummel | |
| 6,250,829 | B1 | 6/2001 | Brower et al. | |
| 6,726,386 | B1 * | 4/2004 | Gruenbacher et al. | 401/7 |

FOREIGN PATENT DOCUMENTS

| | | |
|---|---|---|
| JP | 63-193017 | 12/1988 |
| JP | 6-8823 | 3/1994 |
| JP | 2003-180449 | 7/2003 |
| WO | 01/12749 | 2/2001 |
| WO | WO01/26529 A1 * | 4/2001 |

* cited by examiner

*Primary Examiner*—Tatyana Zalukaeva
*Assistant Examiner*—Ginger T Chapman
(74) *Attorney, Agent, or Firm*—Oblon, Spivak, McClelland, Maier & Neustadt, L.L.P.

(57) ABSTRACT

The invention relates to a packaged article comprising: an article having an outer surface and an inner surface, wherein said inner surface defines a cavity for receiving an appendage of a user, a package surrounding said article; a seam which closes both said package and said cavity of said article, wherein opening of said seam opens both said package and said cavity of said article.

55 Claims, 5 Drawing Sheets

PACKAGED PRODUCT APPLICATOR OR PERSONAL CARE APPLICATOR

The invention relates to a packaged product applicator or personal care article, such as one in which the applicator or article can receive an appendage (such as a hand or finger) of the user so that the user can apply or use a product with the applicator while contact of the product with the skin of the appendage is avoided.

As disclosed in Published Japanese Utility Model Application Heisei 6-8823 (1994), applicators are known for use in applying a cosmetic powder or a cosmetic liquid, in which the applicator is contained in a storage bag of a resin film. The storage of an applicator in a storage bag can be desirable to prevent propagation of germs or access of contaminants to the applicator. However, conventional arrangements can be particularly problematic for using or applying liquid products, such as liquid cosmetic products, because the cosmetic liquid can undesirably contact the users' hands, fingers or clothes with excess liquid upon removal of the applicator from the bag or package. On the other hand, if the applicator is impregnated with a reduced amount of liquid, unsatisfactory application of the product can result.

It is an object of the invention to provide a packaged applicator which can avoid the problems discussed above. In a preferred form, the invention includes an applicator which can be utilized to apply liquid or dry products. Preferably, the applicator includes a cavity that receives an appendage of the user so that the user can hold the applicator by inserting the appendage into the cavity. The product to be applied can be disposed within the package in the region between the applicator and the remainder of the package and/or the product can be impregnated in the exterior of the applicator so that the applicator can be sufficiently dosed or impregnated with the product. The invention is particularly advantageous in applying liquid products, because substantial quantities of the liquid can be associated with the packaged applicator, but because the liquid is maintained isolated from the cavity of the applicator, the product is also isolated from the appendage (e.g., a finger or hand) which is utilized for applying the product. Accordingly, even if the applicator is saturated with the product or if excess product is present in the package, the product can be isolated from the users appendage. Although the invention is particularly preferable where the packaged article or applicator is configured to receive an appendage of the user the invention can also be utilized for other applicators such as pad or wipe applicators.

In a particularly preferred form, a seam which closes the package also closes the cavity of the applicator, such that upon opening of the package, an opening into the cavity of the applicator or article is also formed. As a result, the interior of the cavity of the applicator is isolated from the product disposed in the package. Further, once the package is opened, the user can insert a finger or hand into the cavity of the applicator to use the applicator. In a further optional aspect, the applicator can be fastened to one or more side walls of the package such that after opening of the package, the applicator remains partially attached to one or more side walls of the package. With this feature, after the package is opened, separation of the side walls of the package from one another expands the opening of the applicator cavity to allow the user to more easily insert an appendage into the applicator. Preferably, this fastening or attachment is easily breakable such that after the user's appendage is inserted into the applicator, the fastening of the applicator to the package can be broken and the user can readily remove the applicator from the package. Even where the applicator does not receive the user's appendage (e.g., with a pad or wipe applicator), the coupling of the applicator to the package assists in readily locating the applicator upon opening of the package.

The applicator of the invention can be utilized for applying a wide variety of products. For example, the applicator can be utilized to apply various personal care products such as various cosmetics, including a foundation or other make-up, a skin or hair conditioner, other hair products such as a hair dye, highlight or hair perming product, a fragrance, perfume, or cologne, a skin tanning product such as a sunless tanning product or a sunscreen product, a make-up remover, anti-wrinkle products, vitamins, anti-acne products, a fragrance, an antiseptic, antibacterial, medicinal, therapeutic or first-aid products, a whitening or bleaching agent for the skin, a surfactant or other cleansing product, nail care products such as nail polish or nail polish remover, etc. It is to be understood, however, that the packaged article of the present invention can have a number of additional uses. For example, the article can be utilized as a household cleaning article, for example, for polishing, cleaning, or dusting various household surfaces. The article could also be utilized in automotive care, such as in cleansing, polishing, and/or applying a protectant product to exterior and interior car surfaces, or for other transportation applications, such as for cleansing/maintaining various surfaces of rail, airline or marine vessels. The article can also be utilized for apparel, such as for cleaning/polishing shoes or for garment cleaning.

Although the invention is particularly advantageous for providing a packaged applicator, it could also provide other packaged articles. For example, the article disposed inside of the package could be utilized as a personal care article in which a heat generating substance is associated with the article or is disposed inside of the package between the package and the outer surface of the article. More particularly, compositions which are known to generate heat when exposed to oxygen can be provided such that when the package is opened, the heat generating substance is exposed to air, and heat is generated to warm the article and the appendage disposed within the cavity of the article. The generation of heat can be desirable where the article is a product applicator to warm the product being applied or used with the article. Alternatively, the generation of heat can be desirable by itself to warm the appendage which is inserted into the article. For example, the article can be shaped as a glove or mitt to receive a hand, or as a sock-like article to receive a foot, with the heat generating substance thus warming the hand or foot upon insertion into the cavity the article. With most applications, the article will be removed from the package for use as an applicator after the package is opened. Where the article is a warmer that is not utilized as a product applicator, the article could be utilized without separating the article from the package. Thus, opening of the packaged article can open the cavity of the article so that an appendage can be inserted into the cavity. At the same time, access of air into the region between the article and the package walls provides access of oxygen to the warming substance so that the appendage inserted into the cavity of the article is warmed. With the article maintained fastened to the outer package, the package provides an enclosure about the article and the warming substance to assist in retaining the heat generating substance and, depending upon the packaging, for additional insulation to retain the generated heat. Alternatively, the article itself could have an outer layer which protects inadvertent escape of the warming material (or inadvertent access of moisture or other contaminants to the warming material) and the article can be separated from the outer package for use.

The package containing the applicator or article can have various forms. Preferably the package will allow for long-term storage of the product or substances contained within the package. In a preferred form, the article is a bag or envelope, and is formed of flexible or soft, airtight materials. Such materials can include polyethylene, polypropylene, polyvinyl chloride, polyester, polyamide, and/or a metallic foil or metallic film (such as an aluminum foil or film or a stainless steel foil or film). Metallic films can be formed by various methods, such as by vapor deposition of the metal. The package can be formed of a single layer or of multiple layers of the same or different materials. By way of example, the package can include an aluminum foil or film sandwiched between layers of PET and/or PE. As noted above, if the package is to be maintained with the article after opening and the article is a warmer, the package also preferably has good insulating properties. As should be readily recognized, various materials and combinations of materials can be utilized for the outer package.

The package could also be transparent so that the article is visible through the package. As a further alternative, selected portions of the package could be transparent, for example, having a transparent window or having one side of the package transparent and the other side non-transparent. Such a transparent package (or transparent portion of the package) could be desirable aesthetically and also to assist the user in using the package, for example, to assist in opening the correct end of the package and to identify the correct location for insertion of the appendage into the article inside of the package. The use of a transparent material can also assist the user in retrieving a product from the package after the article is mounted upon an appendage where the article is being used as an applicator. Where a transparent packaging material is utilized, it can be desirable to include a material which is resistant to ultraviolet radiation, such as a "low E" film.

The article/applicator can have various shapes or configurations, such as a shape suitable for receiving a single finger or two or more fingers, or the article could be shaped to receive the users' entire hand or a foot. The article or applicator is preferably formed of multiple layers, with at least one layer impermeable to the product or substance which is disposed on an outer surface of the article and/or within the package. In addition, where the article is an applicator, the outer surface of the article is preferably formed of a material suitable for retaining the product which is to be applied, with the outer surface of the article also suitable for contact with the skin or other surface to which the product is to be applied. By way of example, the outer surface of the applicator can include various materials such as a woven or a non-woven fabric formed of various natural and/or synthetic materials, a foam-like material (including natural or synthetic sponge-like materials) or various combinations of the foregoing (e.g., with a foam or other absorbent layer provided for retaining the product and with the absorbent layer covered by a nonwoven or other soft layer which is desirable for contacting the skin). Non-limiting examples of suitable materials include cotton, animal fibers such as wool, rayon, polyester, polyamide, polyolefinic, or acrylic materials. In a presently preferred form of a two-layer article, the article includes a non-woven material for the outer layer, with an impermeable layer as the inner layer. The impermeable layer can be provided as a separate film layer which is joined to the outer layer(s), or the impermeable layer could be provided as a coating on an inner surface of the outer layer(s). Although the use of a separate impermeable layer is desired, it is not required for all applications, such as where contact of the product being applied is not offensive to the skin of the appendage being utilized to apply the product (e.g., for a powder or talc-like product) or where the product does not easily penetrate the outer layer(s) of the applicator material. Where an impermeable layer is included, it can additionally be desirable to provide a still further layer inside of the impermeable layer so that the inner surface of the article is more comfortable in contact with the skin. More particularly, impermeable layers (such as a resin film or coating) can be uncomfortable when in contact with the skin of the appendage inserted into the article, and perspiration or other moisture can make the article difficult to remove from the appendage after use. Accordingly, a layer can be selected for the innermost surface of the article which is more desirable for contact with the skin of the appendage inserted into the cavity of the article. This third or innermost layer can include various natural or synthetic fabrics or textile materials. Alternatively, where an impermeable layer is the innermost layer, a powder or talc can be provided inside of the cavity to prevent the skin of the appendage from sticking to the inner surface of the article.

The amount of product provided with the article (filled inside of the bag/package and/or impregnated in the article or applicator) according to the invention can vary widely depending upon the product, the type of surface to which the product is applied, as well as the size of the area of the surface to which the product is applied. Where the article is utilized as an applicator, a relatively wide range of amounts of the product can be provided. For example, where it is desirable to ensure that the product does not drip from the article, the amount of product can be selected such that the outer applicator layer(s) of the article is/are not overly saturated. However, if desired, the product could also be provided in an amount which exceeds the saturation level of the applicator so that the user can repeatedly dip the applicator back into the package to replenish the applicator. For certain applications, the amount of product will be quite small, substantially less than the saturation level of the applicator, for example, where the product being applied is a fragrance.

As examples, the percentage of product impregnation may vary from 10 to 1000% and preferably, from 100 to 600%.

Although the invention is particularly desirable for use in applying liquid products, dry products could also be applied such as a powder or cake products, or the product being applied could be a paste-like/semi-solid product. Further, the product could be one which is a liquid or foaming material in use, but which is in dry form (or as a concentrated liquid) prior to use. For example, the product being applied could include a cleansing product such as a foaming surfactant which is present within the package in dry form. Once the user's appendage is inserted into the cavity of the article/applicator and the article is removed, the package can provide a portable reservoir or sink, into which water can be added to activate or dissolve the surfactant (or other product provided in dry or concentrated form). After water is added, the user can dip the article into the package and then proceed to utilize the article to cleanse the face or other surface. Where the article is a multi-layer article, an outer surface layer of the article can be utilized for washing with a surfactant (or for the application of another product), and when use of the product is completed, the article could be turned inside out so that the inner surface layer of the article can be utilized for drying or another finishing/polishing operation. An impermeable layer would also be provided to isolate the inner and outer layers of the article with this type of operation. As a further alternative, the article could have a moist outer surface including water and a surfactant (or other product) so that the article can be used directly upon removal from the package, but also so that additional water could be optionally added, e.g., to enhance foaming of the surfactant or for prolonged cleansing.

As should be readily apparent, the packaged article of the invention provides a wide variety of uses and applications.

According to a further aspect of the invention, an advantageous process/method for manufacturing the packaged article is provided as discussed in further detail herein.

The above and additional objects and advantages of the invention will become readily understood in view of the detailed description herein, particularly when considered in conjunction with the drawings in which:

FIG. 1 schematically represents a first embodiment of the invention;

Figure 1:
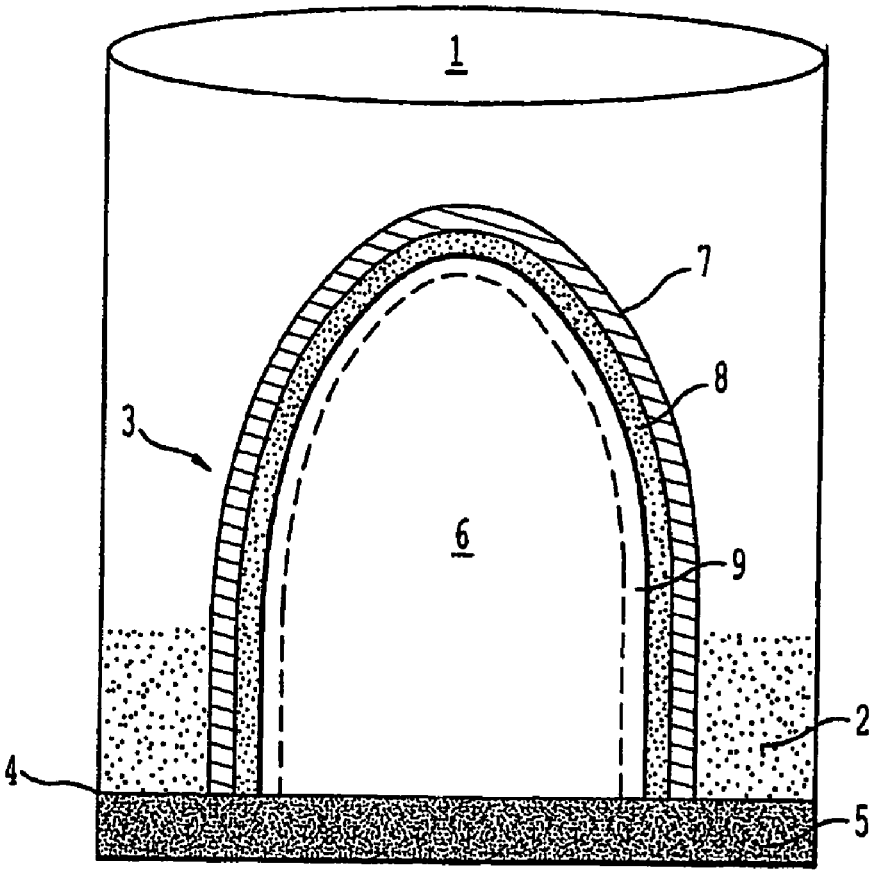

FIG. 1 depicts a first exemplary embodiment of the invention in which the article 3 is disposed within a package 1. As shown in FIG. 1, the article 3 can have a relatively simple form, and can be sized and configured to receive one or more fingers, or to receive a user's entire hand (or another appendage such as the user's foot). The package 1 can have various forms, such as an envelope or bag-like package as shown. Disposed within the package is a product 2 which is to be applied with the article 3. As noted earlier, the product 2 can include a wide variety of substances such as cosmetic or other personal care substances, or the product could be suitable for other cleaning, polishing or other household or commercial care/maintenance chores. The amount of product 2 provided within the package can vary depending upon the product and the area of the surface to which the product is to be applied.

Although the package 1 is shown as a relatively flat envelope-type package, various configurations are possible, for example, the package could be gusseted or include various V, W or accordion folds so that the package is expandable or can provide a more stable package in use. These types of expandable or more stable configurations could be desirable if, for example, a large quantity of product is to be contained in the package and the applicator is to be repeatedly dipped into the package. Such an expandable-type package could also be desirable where the product is present in dry or concentrated liquid form and is wetted or dissolved after the package is opened and the article/applicator 3 is removed. As discussed earlier, with this arrangement, a dry product 2 is provided in the bag, the bag is inverted (as compared with the position shown in FIG. 1), and the package is opened so that the article can be removed. Water can then be added to the package to wet or dissolve the product. The article or applicator 3 can then be dipped into the wetted or dissolved product and applied to the skin, hair or other surface. Such an operation could be desirable, for example, where the article is utilized for cleansing with dry or concentrated surfactants such as a foaming surfactant or other cleansing product present in the region of the package between the package walls and the outer surface 7 of the article 3.

Although the product 2 is shown in the region of the package surrounding the article 3, it is also to be understood that the product could alternately or additionally be associated with the article, for example, by impregnating the article with the product prior to insertion into the package, or by sandwiching the product between layers of the article. Various combinations of the foregoing are also possible. For example, a dry product could be sandwiched between the layers 7, 8 of the article and another product or water/moisture could be added into the surrounding package.

As shown in FIG. 1, a common seam or seal is provided which closes both the package 1 and a cavity 6 of the article 3. As a result, the product 2 provided within the package 1 (and/or impregnated in the outer layer(s) of the article 3) will not enter the cavity 6 of the article. As a result, upon opening of the package, the cavity 6 into the article is opened, and the user can insert an appendage into the cavity 6 without contacting the product. Preferably, a tear line 4 is provided along the seal 5 to assist in tearing the seal 5 from the package. This tear line can be provided as a line of weakening, for example, by utilizing scores or perforations which only partially extend through the packaged article to thereby weaken the package along the tear line (but without extending completely through the tear line until tearing is desired). As noted earlier, the outer surface 7 of the article can be formed of one or more layers which are suitable for applying the product to the skin or other surface.

In the presently preferred form, the outer surface is a non-woven layer, however, various other fabrics or foam materials could be used as discussed earlier. Also, multiple layers could be provided outside of the layer 8 to form the applicator layers 7, e.g., with a foam or more absorbent layer provided for its ability to retain the product and with the absorbent layer covered by a layer best suited for contacting the skin (or other surface to which the product is to be applied) such as a non-woven or other fabric.

Inside of the outer layer(s) 7, an impermeable layer 8 is preferably provided to prevent the product 2 from passing from the layer(s) 7 into the cavity 6. However, as noted earlier, an impermeable layer need not be provided in all circumstances, for example, where the product being applied does not readily penetrate through the layer(s) 7 and/or is not objectionable for contacting the skin of the appendage which is inserted into the cavity 6. Even where some of the product can penetrate through the article into the cavity 6 (e.g., where contact of the product with the skin of the appendage is not objectionable), the use of a common seam to isolate the cavity 6 from the remainder of the interior of the package is desirable in that the majority of the product 2 will be maintained outside of the cavity 6, and there is thus less waste of the product in terms of the amount that can pass into the cavity of the article. The use of one or more layers which prevent penetration of the product 2 to the cavity 6 is particularly important where contact of the product with the skin is objectionable, such as where the product is a dye, a sunless tanning product, or a harsh cleaning composition. As also noted earlier, where an impermeable layer 8 is provided, the layer can be applied as a separate film of various materials such as synthetic resin materials, or the impermeable layer 8 could be provided as a coating deposited on the inner surface of the layer(s) 7.

As represented in broken line in FIG. 1, yet another layer or layers 9 can be provided to form the innermost layer or surface of the article 3. This layer 9 can be desirable so that the user's skin is not in contact with the impermeable layer 8, because impermeable layers can become tacky or uncomfortable, particularly if moist. In addition, if the skin of the appendage should stick to the impermeable layer 8, it can be more difficult to remove the article from the user's appendage. Thus, an additional layer 9 formed, for example, of a natural or synthetic fabric or textile material or of a foam material, can be provided inside of the impermeable layer 8. As noted earlier, this additional layer could also be desirable, for example, where the article is utilized for applying a surfactant for cleansing. With this arrangement, after the outer surface or layer(s) 7 is utilized for washing or cleaning, the article can be turned inside out, and the innermost layer or surface 9 can be utilized for drying or wiping.

In accordance with an optional, but preferred form, the tear-away seam 4 is preferably spaced slightly from the edge (the topmost edge with respect to the orientation of the packaged article in FIG. 1), of the seam 5. With this arrangement, even after the seam 5 is torn-away, a portion of the seam remains such that the article remains attached to one or more walls of the package 1, however this remaining portion of the seam does not seal the cavity 6 of the article 3 so that the user can insert an appendage into the cavity 6. This arrangement can be desirable to prevent the article from dropping into the package before the user has inserted their appendage into the cavity 6. In addition, this remaining partial fastening of the article to the package allows the user to separate the article walls from each other by separating the package walls from each other to make insertion of an appendage into the cavity of the article more convenient. Once the user has inserted their appendage into the cavity 6, the user can either continue pushing upon the article and/or the user can rotate their appendage slightly to dislodge the article from the package and the article can then be removed. It is to be understood that various expedients can be utilized for providing a tear line in addition to or as an alternative to providing a weakened portion along the seam 5. Such expedients could include the use of a tear strip or tear string or other expedients. Alternately, a user could simply cut along the seam with scissors.

As a further alternative, in certain instances it could be desirable to maintain the article 3 fixed to the package even after opening of the packaged article. For example, if the article is to be utilized as a warming device, a heat generating substance 2 can be provided within the package in the region of the package outside of the article 3. The tear line and seam are arranged such that upon opening of the package; the heat generating substance would then be exposed to oxygen so that heat is generated. The user can then insert the appendage into the cavity 6 to warm the appendage. The package can be retained about the article in this instance to assist in preventing inadvertent contact with the heat generating substance and/or for additional insulation about the article 3. Heat generating substances, in and of themselves, are known. By way of example, iron-containing substances (or other metals/alloys, particularly in powder form) are known to generate heat upon exposure to air or oxygen as the iron (or other metal) oxidizes. Various forms of such substances can be devised to control the amount of heat produced by controlling or accelerating the speed of the oxidation reaction. In addition to iron or another metal, such substances can include carbon (such as an activated carbon), vermiculite or salt, and water. By way of example, as disclosed in EP 1 229 097 A1 (which is incorporated herein by reference), heat generating substances have been known for many years, and substances such as activated carbon and vermiculite are well known for use in dosing water so that they can maintain/control the heat or temperature provided by the exothermic reaction. Although these substances have been known, such heat generating substance have not previously been utilized in a packaged article according to the invention. Other heat generating materials could be utilized which generate heat when mixed or when water is added such as acidic anhydrides and basic anhydrides (or salts of the foregoing), or a combination of phosphorous pentoxide and calcium oxide which generate heat when mixed together with water. Additional examples of substances that can generate heat when mixed with water include zeolithes and anhydrous polyalcohols such as ethylene glycol, propylene glycol, etc. In this case, water can be added to the package after opening, or the water could be present in capsules or microcapsules which are broken (e.g., by applying pressure through the surface of the package) when use is desired. Where a heat generating substance is utilized, preferably additional means are provided so that the substance cannot readily escape from the package. For example, the substance can be retained between layers of the package and/or the article such that upon opening of the package, the heat generating substance is exposed to oxygen (or can be wetted with water, e.g., with encapsulated water) but the heat generating substance cannot flow freely from the package.

Figure 2:
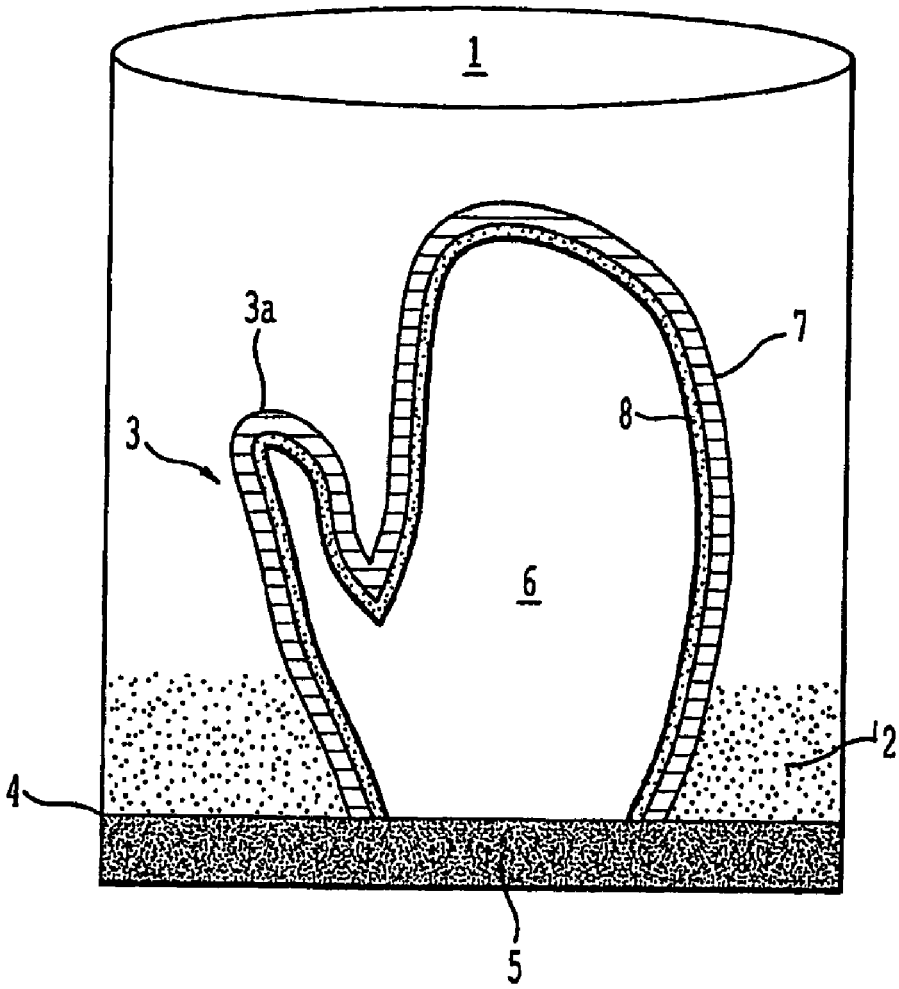
FIG. 2 represents an alternate configuration of the article/applicator of the invention.

FIG. 2 illustrates an arrangement similar to that of FIG. 1, but the shape of the article is different. In the FIG. 2 arrangement, the article is in the form of a mitt, with a thumb extension 3*a*. As with the FIG. 1 embodiment, the article can include a product 2 in the region inside of the package 1 but outside of the cavity 6, and a common seam 5 can be utilized to close both the package 1 and the cavity 6 of the article 3. A tear line or separable construction 4 can be utilized for opening of the seam and thus for opening the package and the cavity as discussed earlier. The article or applicator 3 can include one or more outer layers 7 which are desirable from a standpoint of absorbing and/or applying the product 2. In addition, the article can include an impermeable layer 8, and if desired, one or more inner layers best suited for contact with the skin of the hand and/or which could be utilized for a drying/finishing operation after application of the product 2.

Figure 3:
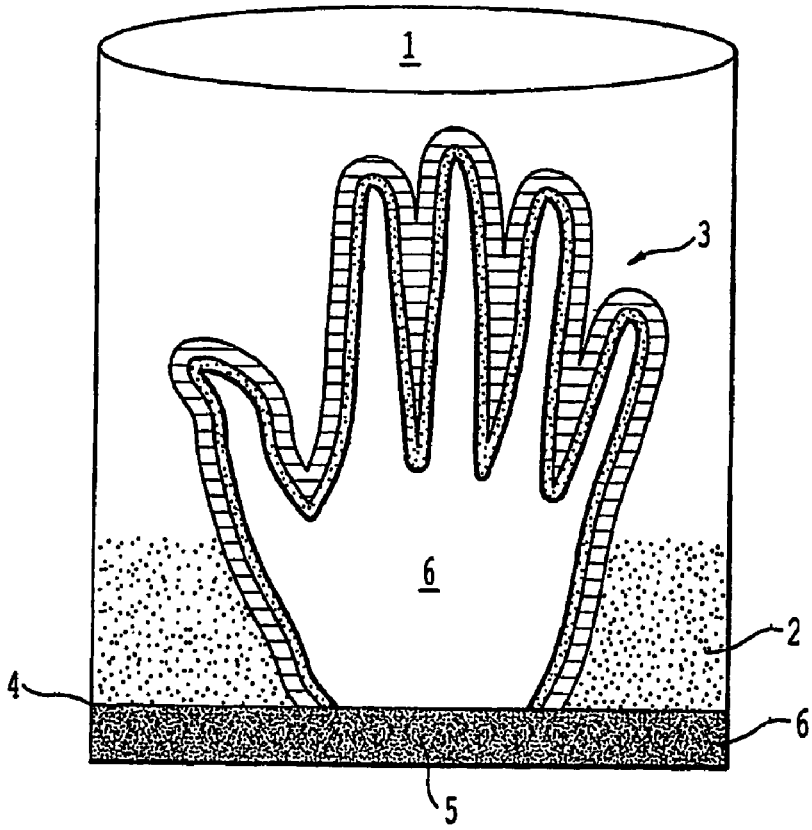
FIG. 3 illustrates a further embodiment of the invention with an alternate configuration of the article/applicator.

FIG. 3 is a further alternative configuration in which the article 3 is in the form of a glove. The glove-like article can be desirable for better control in applying the product to various areas. Also, the glove-like article can be desired if the article is additionally to be utilized for mixing of a product within the package, e.g., where the product is in dry or concentrated form and water is to be added to the product after opening of the package in order to use the product. The glove-like article can provide for better agitation and thus mixing or foaming of such products within the package. As discussed earlier, various other forms are also possible. For example, the article could be shaped as a sock-like article.

According to a still further modified example of the invention, the article could be an applicator that does not have a cavity for receiving an appendage of the user. For example, the article could be a pad or wipe applicator article for applying or using a product disposed in the package and/or impregnated in the article, with the article coupled to the package as discussed in conjunction with the appendage-receiving articles discussed herein. With this arrangement, the applicator can be more readily located and withdrawn from the package upon opening of the package because the applicator is coupled to the package at the seam or closure location of the package. In addition, the appearance of the applicator can be better maintained, because the article can be prevented from becoming "bunched up" in the package.

Figure 4:
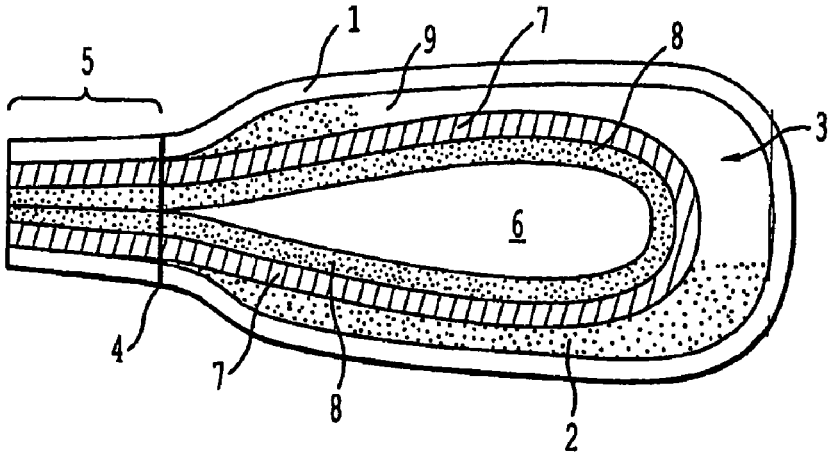
FIG. 4 is a cross-sectional view of the packaged article/applicator of the invention.

FIG. 4 illustrates the packaged article or packaged applicator according to the invention in cross-section. As discussed earlier, and as shown in FIG. 4, the seal or seam 5 will close not only the package, but also the cavity 6 of the article/applicator 3. In addition, a tear line 4 is provided such that upon tearing along the seam 5, not only is the package opened, but the cavity into the article 3 is also opened. The seam can be formed by various methods including adhesive bonding, ultrasonic welding, heat, stitching, etc., or combinations of the foregoing. Similarly, the various seals or seams which complete the periphery of the package and the periphery of the article can also be formed by various means such as heat or ultrasonic welding, adhesives, stitching, etc. Also, certain edges of the package or article could also be formed by folding the material forming the article or package without requiring an additional seal or seam. As also noted earlier, the tear location 4 could be provided at a location such that upon tearing open of the package, the article remains fastened to the package, but the removal of the seam or portion of the seam 5 opens the package and the cavity 6 of the article 3. This can be accomplished by properly positioning the tear line 4 at an edge of the seam 5, at a location at which the heat or other sealing expedient is sufficient such that the outer surface of the article is fastened to the inner surface of the package, but the inner surfaces of the article are not fastened together. Alternately, this result could be achieved by controlling the energy or temperature of the seam forming equipment (or selected portions of the seam forming equipment), or by providing a material at the inner surface of the article in the region of the tear line 4 so that the inner surfaces of the article are not fastened together but the outer surface of the article is at least partially fastened to the inner surface of the package. A further example of this concept is discussed below with reference to FIG. 5. As discussed with reference to the foregoing embodiments, the article 3 can have one or more outer layers 7, preferably formed of materials which are best suited for retaining and applying the product where the article is an applicator, with an additional impermeable layer 8 preferably provided inside of the outer layer(s) 7. As also discussed earlier, one or more additional layers can be provided inside of the layer 8.

The package 1 can be formed of one or multiple layers of resin and/or metallic films or foils. If desired, additional fabric or textile or labeling layers could be provided on the exterior of the package 1 as well. Also, the package 1 can be opaque, or the package can be partially or entirely transparent as discussed earlier. Where the package 1 is partly or entirely transparent, it can be desirable to select a transparent film which provides ultraviolet protection to prevent degradation of the product.

Figure 5:
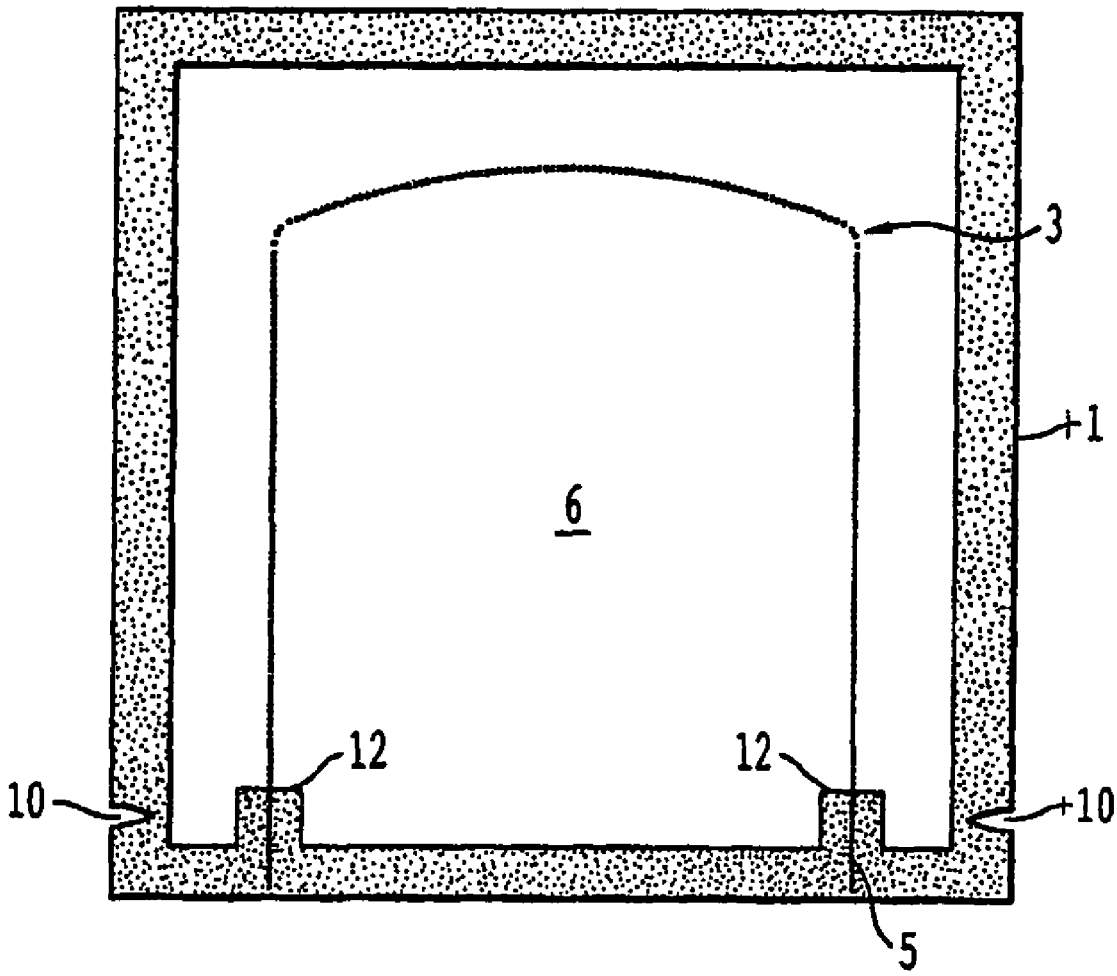
FIG. 5 is a modified embodiment of the invention in which tear-away notches are provided and the article is arranged such that it remains partially fastened to the package after opening.

FIG. 5 illustrates a further example of the invention. In the FIG. 5 embodiment, the article or applicator 3 is represented schematically, however, as discussed earlier, the configuration of the article 3 can have various forms. In the FIG. 5 embodiment, one or more notches 10 are provided at the edges of the package to assist in tearing of the seam 5 from the end of the package along a tear line to thereby open the package and also open the cavity 6 of the article 3. The notches 10 can define a tear-line along which the end of the package will be torn away, and such notches can be used with or without additional weakening, e.g., by scoring or other tear-assisting expedients as discussed earlier with reference to tear line 4. As shown in FIG. 5, an additional seal portion 12 extends from the seal 5 so that when the seam 5 is torn away, a portion of the article remains coupled to the package 1, yet the package and the opening into the cavity 6 are opened. This arrangement assists in holding the article 3 in place and preventing the article from dropping into package 1 upon opening of the package. In addition, this arrangement can assist the user in inserting their appendage into the cavity 6. In particular, by retaining a portion of the article 3 fastened to the walls of the package 1, the user can separate the walls of the package to thereby also separate the inner walls of the article from each other so that the user can more easily insert their appendage into the cavity 6 of the article 3. Once the appendage is inserted, the user can continue pushing of the appendage or the user can rotate the appendage to separate the article form the package. As discussed earlier, various sealing expedients can be utilized for closing the package and the article 3, or for attaching the article 3 to selected locations of the package 1 to retain the package fastened to the inner walls after opening of the package. Also, various seal or seam expedients can be utilized for the remaining edges of the package and article.

Figure 6:
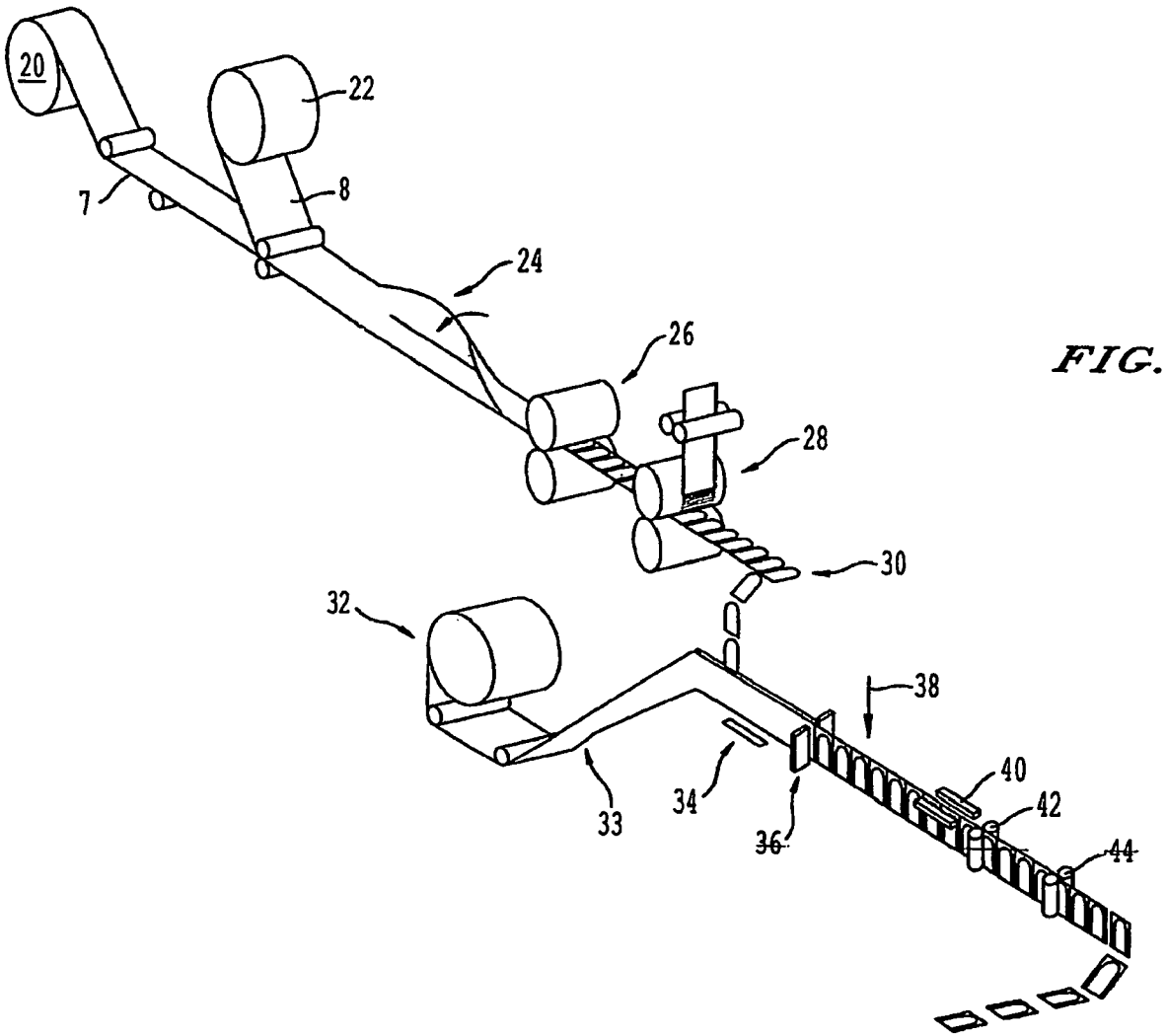
FIG. 6 illustrates a method for manufacturing packaged articles according to the invention.

FIG. 6 illustrates a method of forming the packaged article according to the invention. As shown, the article can be formed of a material forming the outer layer(s) which can be paid-out from a supply roll 20. Although the outer layer 7 appears as a single layer in FIG. 6, as discussed earlier, the outer layer can be formed of multiple layers or plies. Where the article is a product applicator, this outer layer 7 is preferably suited for retaining and applying the product to the skin or other surface to which the product is to be applied. If the outer portion of the article includes multiple layers, they can be stored as a multi-ply substrate upon the roll 20, or they can be successively joined to one another in-line. As shown at 22, an additional roll can pay-out a further layer, such as an impermeable layer 8, such that the product within the package is prevented from entering the cavity 6 of the articles. Although the layer 8 is shown in the form of a substrate or film, as discussed earlier, the impermeable layer can also be deposited as a coating applied onto the layer(s) 7. Where the impermeable layer is a separate web, it can be coupled to the layer 7 by various expedients. For example, a hot melt adhesive can be applied to the substrate web 7 upstream from the location at which the web 8 is overlaid onto the web 7 such that the layers are coupled together when the web 8 is overlaid onto and pressed in contact with the web 7. Alternately, an adhesive in liquid or dry form can be applied to the web 7 with a heat or ultrasonic welding device provided downstream from the location at which the web 8 is overlaid onto the web 7 to activate the adhesive and couple the substrates together. As a further alternative, the substrates could be coupled without the use of an additional adhesive by heat, ultrasonic welding or other suitable means if the substrates 7 and 8 are of suitable materials such that they will adhere together upon application of energy.

After the webs 7, 8 are associated with one another, they are then folded in the illustrated embodiment as represented at 24. This folding operation in part delimits the cavity 6 inside of the article, and the cavity is completed by forming the remaining seams, for example, by a heated die or other expedients (e.g., stitching, ultrasonic welding, etc.) as represented at 26. As an alternative to folding as illustrated at 24, it is also to be understood that one or more additional layers could be overlaid onto the layer 8. The use of additional layers in lieu of folding can be desirable if, for example, it is desirable to form an article having one side with an outer surface having different properties than the other side. For example, where the article is utilized for applying a product to the skin or for skin care, surfaces of different roughnesses can be provided on different sides of the article so that the user can select a surface roughness most comfortable. Thus, as an alternative to folding of the combined layers 7, 8, additional layers could be overlaid onto the layer 8 with seams then formed around the periphery of the article to define the cavity 6.

After the profile/periphery of the articles is formed, the excess material is removed as illustrated at 28 so that discretely formed articles suitable for receiving an appendage of the user are provided as illustrated at 30.

As indicated at 32, a further supply roll 32 is provided for forming the outer package. As noted earlier, the package can be formed of various single or multiple layer/multiple ply materials including various resins, foils, films and combinations of the foregoing. In the embodiment illustrated, by way of example, the substrate which will form the package is folded upwardly (as represented schematically at 33) such that it is open at the top, and the formed articles can then be inserted into the open top of the folded web as shown. As represented at 34 a seal can then be formed at the bottom (along the fold) to seal both the bottom of the package and also to seal the bottom (with respect to the orientation of FIG. 6) of the article. As previously discussed, upon opening of this bottom seam, both the package and the article are opened.

Side seams are then formed as illustrated at 36 to thus form the side seams of the package and also to separate the packages from one another. Thereafter, the product which is to be applied with the article/applicator can be deposited into the package as represented at 38, followed by sealing of the top of the package as represented at 40. In addition, notches or other arrangements for weakening a tear line can be provided as represented at 42. Thereafter, the packaged articles can then be separated from one another and any waste material can be removed by one or more cutting operations as represented at 44. As discussed earlier, various expedients can be provided for easing removal of the bottom seam of the packaged article to thereby open both the package and the cavity of the article. In forming of the side seams or in forming of the bottom seam, or at a separate location, a suitable seal or fastening can optionally be provided so that the article is fastened to the package at a location such that partial fastening of the article to the package remains even after the bottom seam of the package is removed to open the package and the cavity of the article. This can be achieved, for example, when forming the bottom seal by utilizing a seal device that will provide a profile as depicted in FIG. 5.

As should be apparent from the foregoing, the present invention provides a packaged applicator or other article with a wide variety of uses. The following examples are not to be construed as limiting as to the scope of the invention, but rather, are intended as further illustrations of examples of the invention.

EXAMPLE NO. 1

Using laminated layers of polyethylene film and a non-woven fabric of rayon, a bag shaped applicator as shown in FIG. 1 was made. Then the applicator was combined with a laminated film including a polypropylene film with inner face of aluminum (vapor deposited). The applicator was packaged as shown in FIG. 1 with a product in the form of a self tanning or sunless tanning lotion. The sealed bag and applicator had excellent airtight (oxygen barrier) properties and durability, and consequently the product could be stored for a long time. When opened from an I-notch provided at the end part of the sealed bag, a user inserted their hand in the closed space of the bag shaped applicator for facial care. The article demonstrated good applicator capabilities for the self tanning lotion, and did not make the user's hands or clothes dirty.

EXAMPLE NO. 2

With the same method as Example No. 1, another applicator containing a polishing liquid as shown in FIG. 2 was formed. The sealed bag containing this applicator was excellent in durability and oxygen barrier properties, so that the polishing liquid could be kept for a long time.

When opened from an I-notch provided at the end part of the sealed bag, a user's hand was inserted in the cavity of the applicator and used for polishing furniture. The article demonstrated good applicator capabilities for the polishing liquid, and did not make the user's hand or clothes dirty.

EXAMPLE NO. 3

With the same method as Example No. 1, an applicator was formed in a package with a UV protectant sunscreen lotion, with the configuration as shown in FIG. 3. The sealed package and applicator was excellent in durability and oxygen barrier properties, and the liquid lotion could be stored for a long time.

The package was opened from an I-notch provided at the end part of the sealed bag. The user's hand was inserted into the cavity, and the lotion was applied to the face. The article had good application properties, and prevented the lotion from contacting the user's hand or clothes.

EXAMPLE NO. 4

With the applicator as shown in FIG. 2, an applicator with a cosmetic liquid having whitening ingredients was formed. The sealed package and applicator were excellent in durability and oxygen barrier properties, and the liquid could be maintained for a long time.

The package was opened from the I-notch, the user's hand was inserted into the cavity and the article was used for facial care. The article had good application properties, and prevented the lotion from contacting the user's hand or clothes.

Obviously, numerous modifications and variations of the present invention are possible in light of the above teachings. It is therefore to be understood that, within the scope of the appended claims, the invention may be practiced otherwise than as specifically described herein.

The invention claimed is:

1. A packaged article comprising:

an article having an outer surface and an inner surface, wherein said inner surface defines a cavity for receiving an appendage of a user;

a package surrounding said article;

a seam which closes both said package and said cavity of said article, wherein said seam extends through a portion of said package and wherein said seam also extends through a portion of said article, and further wherein opening of said seam opens both said package and said cavity of said article, wherein after opening of said seam a portion of said seam maintains part of said article connected to part of said package, and wherein said portion of said seam extends transverse to a remainder of said seam.

2. A packaged article as recited in claim 1, wherein said seam is a tear-away seam which can be torn from said packaged article, and wherein tearing away of said seam tears away a portion of said article and a portion of said package to open said cavity and said package.

3. A packaged article as recited in claim 1, wherein said article comprises at least one impermeable layer and at least one absorbent layer, and wherein said impermeable layer is disposed inside of said absorbent layer such that said cavity is isolated from said absorbent layer.

4. A packaged article as recited in claim 3, wherein said article is a product applicator, and wherein a product is held by said absorbent layer.

5. A packaged article as recited in claim 4, wherein said article is configured to receive a finger or a hand in said cavity.

6. A packaged article as recited in claim 4, wherein said product is a polish, a cleaning product, or a liquid to pasty cosmetic product, for example, a cosmetic foundation, a skin tanning product, a hair product, a dye, a make-up product,.

7. A packaged article as recited in claim 1, further comprising means for generating heat upon exposure of said article to oxygen.

8. A packaged article as recited in claim 4, wherein said absorbent layer comprises an absorbent foam material.

9. A packaged article as recited in claim 4 wherein said absorbent layer comprises a non-woven fabric.

10. A packaged article as recited in claim 1, wherein said article comprises a first layer, a second impermeable layer, and a third layer, and wherein said first and third layers are formed of at least one of a fabric and a foam material.

11. A packaged article as recited in claim 7, wherein said article comprises an impermeable layer to isolate said material that generates heat from said cavity.

12. A packaged article as recited in claim 1, wherein said article comprises at least a first layer and a second layer, and wherein said first layer comprises one of a foam material and a fabric, and wherein said second layer is an impermeable layer, and wherein said second layer isolates at least a portion of said first layer from said cavity.

13. A packaged article as recited in claim 12, wherein said article further comprises a third layer which is adjacent to the skin of a user upon insertion of an appendage into said cavity, and wherein said second layer is disposed between said first layer and said third layer.

14. A packaged article as recited in claim 12, wherein said package comprises plural layers, and wherein at least one of said layers is opaque.

15. A packaged article as recited in claim 14, wherein said plural layers of said package comprises a first layer that comprises a resin.

16. A packaged article as recited in claim 15, wherein said plural layers of said package further comprises a second layer that comprises one of a metallic foil and a metallic film.

17. A packaged article as recited in claim 12, wherein said package comprises a transparent layer.

18. A packaged article as recited in claim 12, wherein said package comprises a transparent film which is resistant to ultraviolet radiation.

19. A packaged article as recited in claim 1, further comprising a product which is present in dry form and which is dissolved in water for use.

20. A packaged article as recited in claim 19, wherein said product comprises a surfactant.

21. A packaged article as recited in claim 20, wherein said article comprises a non-woven fabric.

22. A packaged article as recited in claim 1, further comprising a product disposed in said package in concentrated form which is diluted in water for use.

23. A packaged article according to claim 1, wherein the article is an applicator, the package enclosing said applicator so that an enclosed region is defined between an inner surface of said package and said outer surface of said applicator, and further wherein, prior to opening of said package said cavity of said applicator is isolated from said enclosed region, a product being disposed in at least one of said enclosed region of said package and said applicator.

24. A packaged applicator as recited in claim 23, wherein said applicator comprises an impermeable layer such that said inner surface of said applicator is isolated from said outer surface of said applicator.

25. A packaged applicator as recited in claim 24, wherein said product is a cosmetic product, especially in a liquid to pasty form.

26. A packaged applicator as recited in claim 25, wherein said applicator further comprises a fabric layer, especially a non woven, forming said outer surface of said applicator.

27. A packaged applicator as recited in claim 25, wherein said product is a liquid product, and wherein said product is disposed in said enclosed region.

28. A packaged applicator as recited in claim 23, wherein said applicator comprises at least two layers, said two layers comprising a fabric layer, and an impermeable layer.

29. A packaged applicator as recited in claim 28, further comprises a seam which closes both said cavity of said applicator and said enclosed region of said package, whereby opening of said seam opens said package and opens said cavity such that a user can insert an appendage inside of said cavity.

30. A packaged applicator as recited in claim 29, wherein said applicator is fastened to said package at at least one location such that said applicator remains fastened to said package after opening of said seam.

31. A packaged applicator as recited in claim 29, wherein said seam is a tear-away seam which can be torn from said packaged applicator, and wherein tearing away of said seam tears away a portion of said applicator and a portion of said package.

32. A packaged applicator as recited in claim 23, wherein said product is in dry form and is dissolved in water for use.

33. A packaged applicator as recited in claim 32, wherein said product comprises a surfactant.

34. A packaged applicator as recited in claim 23, wherein said product is disposed in said package in a concentrated form which is diluted in water for use.

35. A process for forming a packaged article comprising:

forming an article having a cavity for receiving an appendage of a user;

inserting said article into a partially formed package; and sealing an end of said package to form a seam which both forms a seam for said package and closes said cavity of said article, wherein said seam extends through a portion of said package and wherein said seam also extends through a portion of said article such that opening of said seam opens both said package and said cavity of said article, wherein after opening of said seam a portion of said seam maintains part of said article connected to part of said package, and wherein said portion of said seam extends transverse to a remainder of said seam.

36. A process as recited in claim 35, wherein the step of forming said article comprises forming an article with an impermeable layer and at least one layer disposed exteriorly to said impermeable layer.

37. A process as recited in claim 36, wherein said at least one layer comprises one of a foam and a fabric layer, especially a non-woven.

38. A process as recited in claim 35, further comprising adding a product into said package after said step of sealing an end.

39. A process as recited in claim 38, wherein said product is a liquid to pasty product.

40. A process as recited in claim 39, wherein said product is a cosmetic product.

41. A packaged article comprising:

i) a product applicator;

ii) a package surrounding said product applicator;

iii) a product to be applied by said product applicator, said product being contained inside said package and being in contact with the product applicator;

iv) a seam which closes said package and which fastens the product applicator to said package, wherein the opening of said seam opens said package and allows for the product applicator to be accessed to apply said product, wherein said seam extends through a portion of said package and wherein said seam also extends through a portion of said article, wherein after opening of said seam a portion of said seam maintains part of said article connected to part of said package, and wherein said portion of said seam extends transverse to a remainder of said seam.

42. A packaged article as recited in claim 41, wherein said product is a cosmetic product.

43. A packaged article as recited in claim 41, wherein said product is in dry form and said product is dissolved in water for use.

44. A packaged article as recited in claim 41, wherein said product is in a concentrated form and is diluted in water for use.

45. A packaged article as recited in claim 41, wherein said product comprises a surfactant.

46. A packaged article as recited in claim 41, wherein said product applicator is an applicator pad or comprises a non woven fabric.

47. A packaged article as recited in claim 41, wherein said product applicator comprises a cavity for receiving an appendage of a user.

48. A packaged article as recited in claim 47, wherein said seam closes both said package and said cavity and wherein opening of said seam opens said cavity.

49. A packaged article as recited in claim 41, wherein said product applicator is fastened to said package at at least one location such that said product applicator remains fastened to said package after opening of said seam and such that said product applicator can be unfastened from said package upon application of a force after opening of said seam.

50. A packaged article as recited in claim 1, wherein said package includes an interior portion between an inner surface of said package and the outer surface of said article, and wherein, prior to opening of said seam, said seam closes said cavity with respect to said interior portion of said package such that said cavity is isolated from said interior portion of said package.

51. A packaged articled as recited in claim 50, wherein said seam seals selected inner surface portions of said article together and selected inner surface portions of said package together, and wherein said seam is a common seam to both said package and said article.

52. A packaged article as recited in claim 51, wherein said seam also seals additional inner surface portions of said package to selected outer surface portions of said article.

53. A packaged articled as recited in claim 1, wherein said seam seals selected inner surface portions of said article together and selected inner surface portions of said package together, and wherein said seam is a common seam to both said package and said article.

54. A packaged article as recited in claim 53, wherein said seam also seals additional inner surface portions of said package to selected outer surface portions of said article.

55. A packaged article as recited in claim 1, wherein said seam additionally couples said article to said package such that at least prior to opening said article is connected to said package by said seam.

* * * * *